US010486927B2

(12) United States Patent
Fujinuma et al.

(10) Patent No.: US 10,486,927 B2
(45) Date of Patent: Nov. 26, 2019

(54) SHEET FEEDING APPARATUS AND IMAGE FORMING APPARATUS

(71) Applicant: CANON KABUSHIKI KAISHA, Tokyo (JP)

(72) Inventors: Yasuhito Fujinuma, Susono (JP); Shunsuke Okazaki, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/952,649

(22) Filed: Apr. 13, 2018

(65) Prior Publication Data

US 2018/0229954 A1 Aug. 16, 2018

Related U.S. Application Data

(63) Continuation of application No. 15/412,398, filed on Jan. 23, 2017, now Pat. No. 9,975,717.

(30) Foreign Application Priority Data

Jan. 28, 2016 (JP) ..... 2016-014739

(51) Int. Cl.
*B65H 7/04* (2006.01)
*B65H 1/04* (2006.01)
(Continued)

(52) U.S. Cl.
CPC ..... *B65H 7/04* (2013.01); *B65H 1/04* (2013.01); *B65H 1/18* (2013.01); *B65H 1/266* (2013.01);
(Continued)

(58) Field of Classification Search
CPC ..... B65H 1/08; B65H 1/18; B65H 3/0607; B65H 3/0684; B65H 7/00; B65H 7/02;
(Continued)

(56) References Cited

U.S. PATENT DOCUMENTS 5,123,637 A * 6/1992 Musaka ..... G03G 15/6502 271/117
7,460,825 B2 12/2008 Sawanaka et al.
(Continued)

FOREIGN PATENT DOCUMENTS

CN 1661486 A 8/2005
CN 101592890 A 12/2009
(Continued)

OTHER PUBLICATIONS

Office Action dated Nov. 1, 2018, in Chinese Patent Application No. 201710053324.5.

*Primary Examiner* — Prasad V Gokhale
(74) *Attorney, Agent, or Firm* — Venable LLP

(57) ABSTRACT

A sheet feeding apparatus includes a sheet presence/absence detection sensor configured to detect presence or absence of a sheet on a stacking device, a sheet surface detection sensor configured to detect that a stacking tray is raised to enable a sheet to be fed, a separation cam, and a control unit. The control unit is configured to determine that the mounting state of a feeding holder to a holder support unit is defective when the sheet surface detection sensor detects that the sheet can be fed when the sheet presence/absence detection sensor detects absence of a sheet before sheet feeding processing by a pickup roller.

6 Claims, 8 Drawing Sheets

(51) Int. Cl.

| | |
|---|---|
| ***B65H 1/18*** | (2006.01) |
| ***B65H 3/06*** | (2006.01) |
| ***B65H 7/14*** | (2006.01) |
| ***B65H 1/26*** | (2006.01) |

(52) U.S. Cl.
CPC ..... *B65H 3/0684* (2013.01); *B65H 7/14* (2013.01); *B65H 2511/51* (2013.01); *B65H 2511/515* (2013.01); *B65H 2511/52* (2013.01); *B65H 2801/12* (2013.01)

(58) Field of Classification Search
CPC ... B65H 7/04; B65H 7/14; B65H 7/18; B65H 7/20; B65H 2553/612; B65H 2404/152; B65H 2404/1521; B65H 2511/51; B65H 2404/515
USPC ..... 271/113, 117, 118
See application file for complete search history.

(56) References Cited

U.S. PATENT DOCUMENTS

| | | | | |
|---|---|---|---|---|
| 7,992,859 | B2 | 8/2011 | Shiina | |
| 8,556,253 | B2 | 10/2013 | Okazaki | |
| 8,714,543 | B2 | 5/2014 | Matsushima et al. | |
| 9,126,789 | B2 | 9/2015 | Hori et al. | |
| 9,371,204 | B2 | 6/2016 | Inoue et al. | |
| 10,144,599 | B2 * | 12/2018 | Wakabayashi | B65H 3/06 |
| 2013/0222505 | A1 * | 8/2013 | Akatsuka | B41J 11/0095 347/110 |
| 2014/0151954 | A1 | 6/2014 | Furusawa et al. | |
| 2016/0227060 | A1 | 8/2016 | Higashimura et al. | |
| 2016/0297631 | A1 | 10/2016 | Okazaki et al. | |
| 2017/0153589 | A1 * | 6/2017 | Sato | G03G 15/6529 |

FOREIGN PATENT DOCUMENTS

| | | | |
|---|---|---|---|
| JP | 2000-191154 | A | 7/2000 |
| JP | 2007-22762 | A | 2/2007 |
| JP | 4466440 | B2 | 5/2010 |
| JP | 2011-136811 | A | 7/2011 |
| JP | 2014-31269 | A | 2/2014 |

* cited by examiner

SHEET FEEDING APPARATUS AND IMAGE FORMING APPARATUS

This application is a continuation of U.S. patent application Ser. No. 15/412,398, filed Jan. 23, 2017, which claims the benefit of Japanese Patent Application No. 2016-014739, filed Jan. 28, 2016, both of which are hereby incorporated by reference herein in their entirety.

BACKGROUND OF THE INVENTION

Field of the Invention

The present invention relates to a sheet feeding apparatus, which is configured to feed a sheet, and an image forming apparatus.

Description of the Related Art

In general, an image forming apparatus, such as a printer, a copying machine, or a facsimile machine, includes a sheet feeding apparatus configured to feed a sheet to an image forming unit. There is given such sheet feeding apparatus configured to stack a sheet on a stacking tray that is arranged in a sheet receiving unit and is capable of being raised and lowered, raise the stacking tray to a position at which the sheet can be fed, and then deliver the sheet to the image forming unit by a feeding unit (see Japanese Patent Application Laid-Open No. 2011-136811). In such sheet feeding apparatus, the sheet receiving unit is configured to be mountable to and drawable from a main body of the sheet feeding apparatus so that sheets can easily be stacked on the sheet receiving unit during stacking of sheets. Further, the stacking tray is lowered to a predetermined sheet stacking position in conjunction with the drawing operation.

The sheet feeding apparatus which employs a raising and lowering system in the related art has the following configuration. When a sheet bundle stacked on the stacking tray is raised, an uppermost sheet of the sheet bundle is brought into abutment against a pickup roller. When the pickup roller is rotated, a flag unit arranged on a roller holder (hereinafter referred to as "feeding unit") moves to respond to a sensor. With this configuration, even when floating, warpage, and the like occur in the sheets during stacking of the sheets, the uppermost sheet can be detected accurately at a pickup position. Thus, a pickup operation (feeding operation) can be performed accurately.

However, according to the configuration of Japanese Patent Application Laid-Open No. 2011-136811, when the raising operation of the stacking tray is started under the condition that the feeding unit is not mounted, for example, under the condition that a user has forgotten to mount the feeding unit which has been removed temporarily at a time of roller replacement, a signal for stopping the raising operation cannot be detected. In such case, the stacking tray may be raised to a position higher than a prescribed level to damage surrounding constituent portions or cause trouble such as jam (paper jam). Further, even when the stacking tray does not damage the surrounding constituent portions, the following problem may arise. When the user performs printing in this state, the sheet is not fed, and jam is determined. As a result, it is difficult for the user to notice that the jam has been caused by the absence of a roller.

SUMMARY OF THE INVENTION

It is an object of the present invention to provide a sheet feeding apparatus having a configuration capable of determining whether or not a mounting state of a feeding unit is appropriate before sheet feeding processing.

According to one embodiment of the present invention, there is provided a sheet feeding apparatus, which is configured to feed a sheet, including: a stacking device onto which a sheet is stacked and which is capable of being raised and lowered; a feeding unit including a feeding member configured to be brought into abutment against the sheet on the stacking device to feed the sheet, the feeding unit being configured to hold the sheet feeding member; a support device arranged above the stacking device and configured to removably support the feeding unit; a first detection device configured to detect presence or absence of the sheet on the stacking device; a second detection device configured to detect that the stacking device is raised to enable the sheet to be fed; and a control unit configured to determine that a mounting state of the feeding unit to the support device is defective when the second detection device detects that the sheet is allowed to be fed while the first detection device detects absence of the sheet before sheet feeding processing by the feeding member.

According to another embodiment of the present invention, there is provided an image forming apparatus, including a stacking device onto which a sheet is stacked and which is capable of being raised and lowered; a feeding unit comprising a feeding member configured to be brought into abutment against the sheet on the stacking device to feed the sheet, the feeding unit being configured to hold the sheet feeding member; an image forming unit configured to form an image on the sheet fed by the feeding member; a support device arranged above the stacking device and configured to removably support the feeding unit; a first detection device configured to detect presence or absence of the sheet on the stacking device; a second detection device configured to detect that the stacking device is raised to enable the sheet to be fed; and a control unit configured to determine that a mounting state of the feeding unit to the support device is defective when the second detection device detects that the sheet is allowed to be fed while the first detection device detects absence of the sheet before sheet feeding processing by the feeding member.

Further features of the present invention will become apparent from the following description of exemplary embodiments with reference to the attached drawings.

DESCRIPTION OF THE EMBODIMENTS

First Embodiment

Now, a sheet feeding apparatus (image forming apparatus) according to a first embodiment of the present invention is described with reference to the drawings. The image forming apparatus according to this embodiment can be a copying machine, a printer, a facsimile machine, a multifunction peripheral of those, or the like. In the following embodiment, description is made through use of an electrophotographic laser printer (hereinafter referred to as "printer"). In this embodiment, description is made assuming that the sheet feeding apparatus of the present invention is the same as an image forming apparatus (printer 1).

Figure 1:
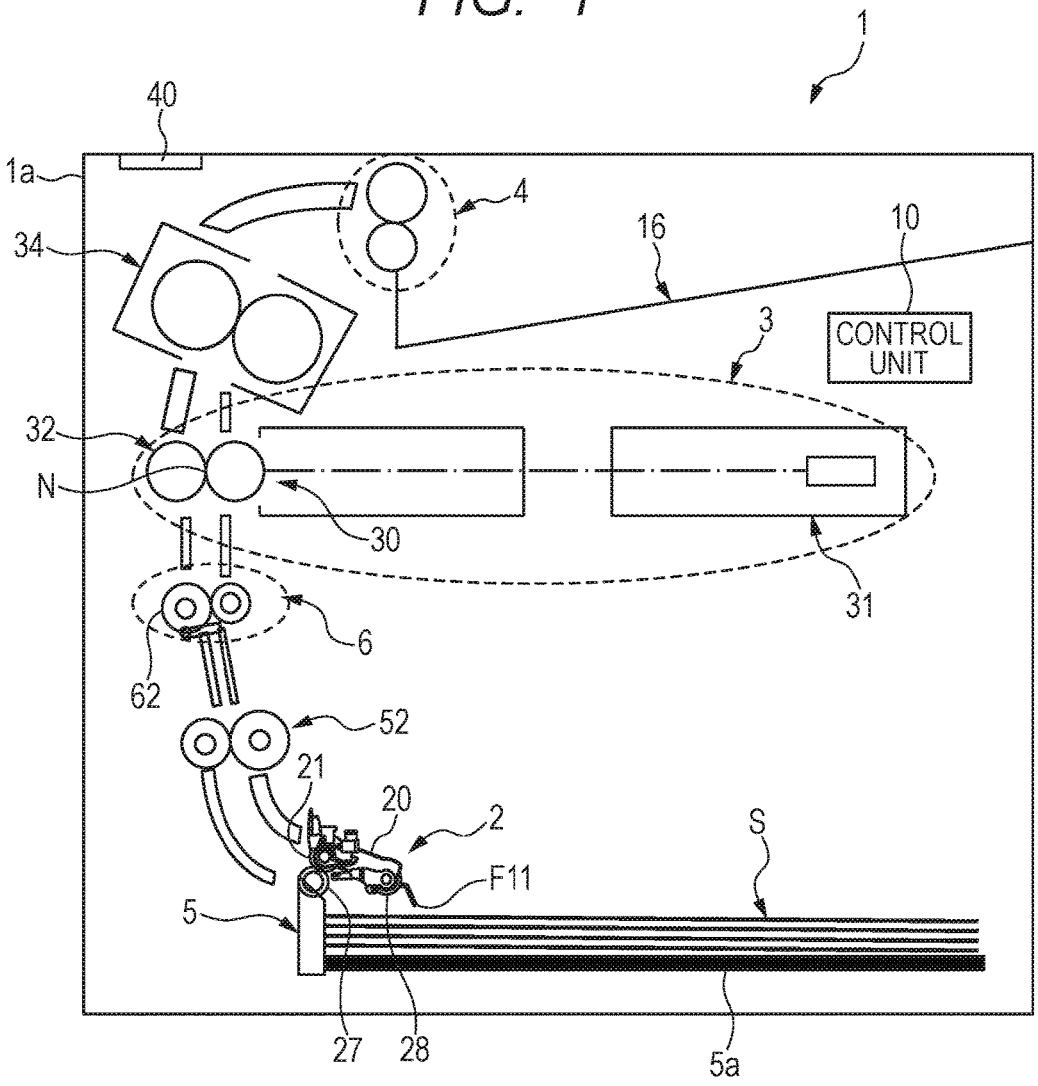
FIG. 1 is a sectional view for schematically illustrating a printer according to a first embodiment of the present invention.
Figure 6:
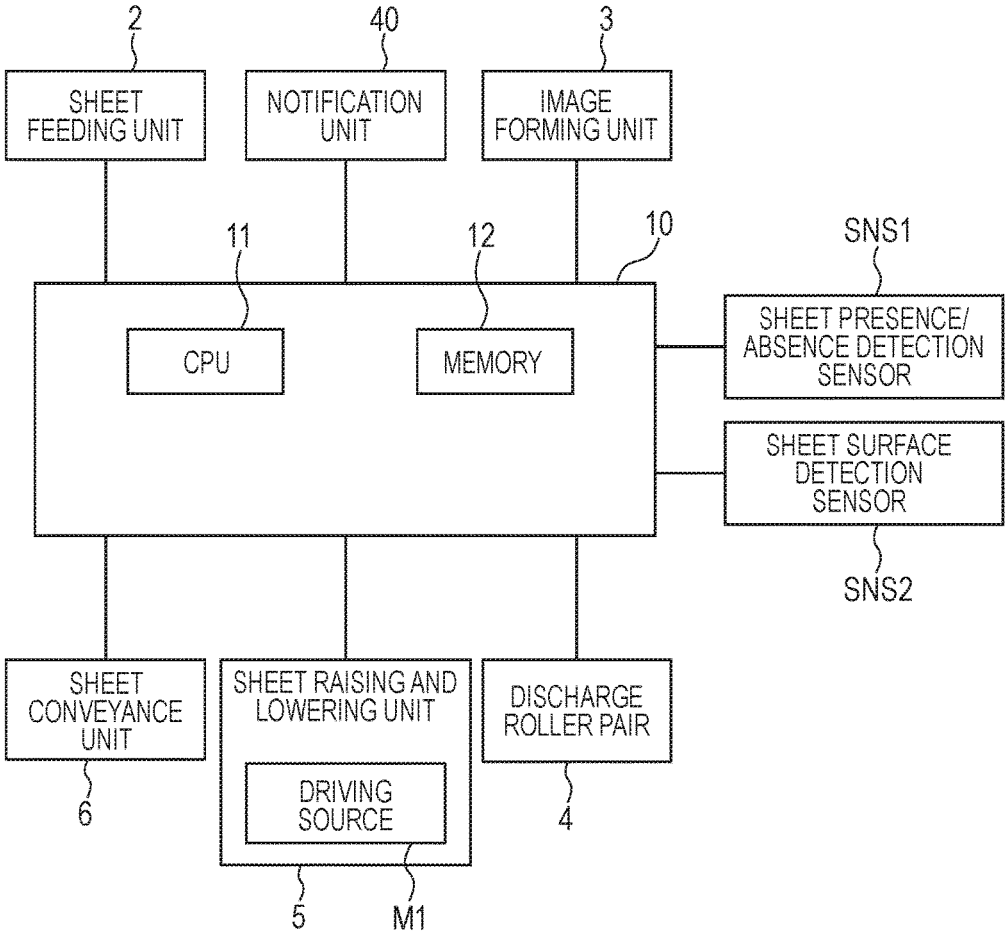
FIG. 6 is a block diagram for illustrating a control system of the printer according to the first embodiment.

First, the schematic configuration of the printer 1 (sheet feeding apparatus) is described with reference to FIG. 1 and FIG. 6. FIG. 1 is a sectional view for schematically illustrating the printer 1 according to this embodiment. FIG. 6 is a block diagram for illustrating a control system including a control unit 10 arranged in the printer 1 according to this embodiment.

As illustrated in FIG. 1, the printer 1 includes a printer main body 1*a* serving as a device main body. The printer main body 1*a* includes a sheet feeding unit 2 configured to feed sheets S, an image forming unit 3 configured to form an image on the sheet S, and a discharge roller pair 4 configured to deliver the sheet S onto a sheet delivery unit 16 arranged in an upper portion of the printer main body 1*a*. The printer main body 1*a* further includes a sheet raising and lowering unit 5 configured to perform a raising and lowering operation of a stacking tray 5*a*, a sheet conveyance unit 6 configured to convey the sheet S, and the control unit (control device) 10 configured to control each portion of the printer 1 including the foregoing portions. The stacking tray 5*a* forms a stacking device onto which the sheet S is stacked and which can be raised and lowered.

The sheet feeding unit 2 includes a feeding holder 20, a pickup roller 28 and a feed roller 21 held by the feeding holder 20, and a separation roller 27 arranged so as to be opposed to a lower portion of the feed roller 21. The sheet feeding unit 2 is configured to separate the sheets S stacked on the stacking tray 5*a* one by one and deliver the sheet S to the sheet conveyance unit 6 through a pull-out roller pair 52. The sheet S is corrected for a skew in the sheet conveyance unit 6 including a registration roller pair 62, and then is conveyed to the image forming unit 3.

The image forming unit 3 includes a photosensitive drum 30 serving as an image bearing member, an exposure device 31 configured to irradiate the photosensitive drum 30 with laser light, a transfer roller 32 configured to transfer a toner image onto the sheet S, and a fixing device 34 configured to fix the toner image transferred onto the sheet S. A nip between the photosensitive drum 30 and the transfer roller 32 forms a transfer portion N. The image forming unit 3 and the fixing device 34 form an image forming device configured to form an image on the sheet delivered from the sheet feeding unit 2. The sheet feeding unit 2 is described later in detail.

The control system in this embodiment includes the control unit 10 arranged in the printer main body 1*a* as illustrated in FIG. 6. The control unit 10 includes a CPU 11 configured to drive and control the sheet feeding unit 2 and the like and a memory 12 configured to store various programs. The control unit 10 is connected to the sheet feeding unit 2, a notification unit 40, the image forming unit 3, the sheet conveyance unit 6, the sheet raising and lowering unit 5 including a driving source M1, e.g., a motor, and the discharge roller pair 4. The control unit 10 is further connected to a sheet presence/absence detection sensor SNS1 and a sheet surface detection sensor SNS2.

The control unit 10 is configured to control the sheet feeding unit 2, the image forming unit 3, the sheet conveyance unit 6, the sheet raising and lowering unit 5, the discharge roller pair 4, and the like based on signals from sensors, for example, the sheet presence/absence detection sensor SNS1 and the sheet surface detection sensor SNS2. The notification unit 40 forms a warning device configured to issue a warning.

Next, with reference to FIG. 1 and FIG. 6, description is made of an image forming job (image forming control by the control unit 10) of the printer 1 mainly in relation to the above-mentioned components.

Specifically, when the image forming job is started, the exposure device 31 irradiates a surface of the photosensitive drum 30 with laser light in accordance with an image information signal transmitted from a personal computer (PC) or a scanner (not shown). With this, the surface of the photosensitive drum 30 charged to a predetermined polarity potential is exposed to light, and an electrostatic latent image is formed on the surface. When the electrostatic latent image is formed on the surface of the photosensitive drum 30, a developing unit (not shown) develops the electrostatic latent image so that the electrostatic latent image is visualized as a toner image.

The sheet feeding unit 2 feeds the sheet S while separating the sheets S one by one simultaneously with the above-mentioned toner image forming operation. Then, the sheet S is conveyed to the transfer portion N from the registration roller pair 62 of the sheet conveyance unit 6 arranged on the downstream of the sheet feeding unit 2. When the sheet S is conveyed to the transfer portion N, the transfer roller 32 transfers the toner image formed on the photosensitive drum 30 onto the sheet S. The sheet S having the toner image transferred thereonto is heated and pressurized by the fixing device 34, with the result that the toner image is fixed. The sheet S having the toner image fixed thereon is delivered to outside through the discharge roller pair 4 and stacked on the sheet delivery unit 16 in the upper portion of the printer main body 1*a* with an image surface faced downward (face-down state).

Sheet Raising and Lowering Unit and Sheet Feeding Unit

Figure 2:
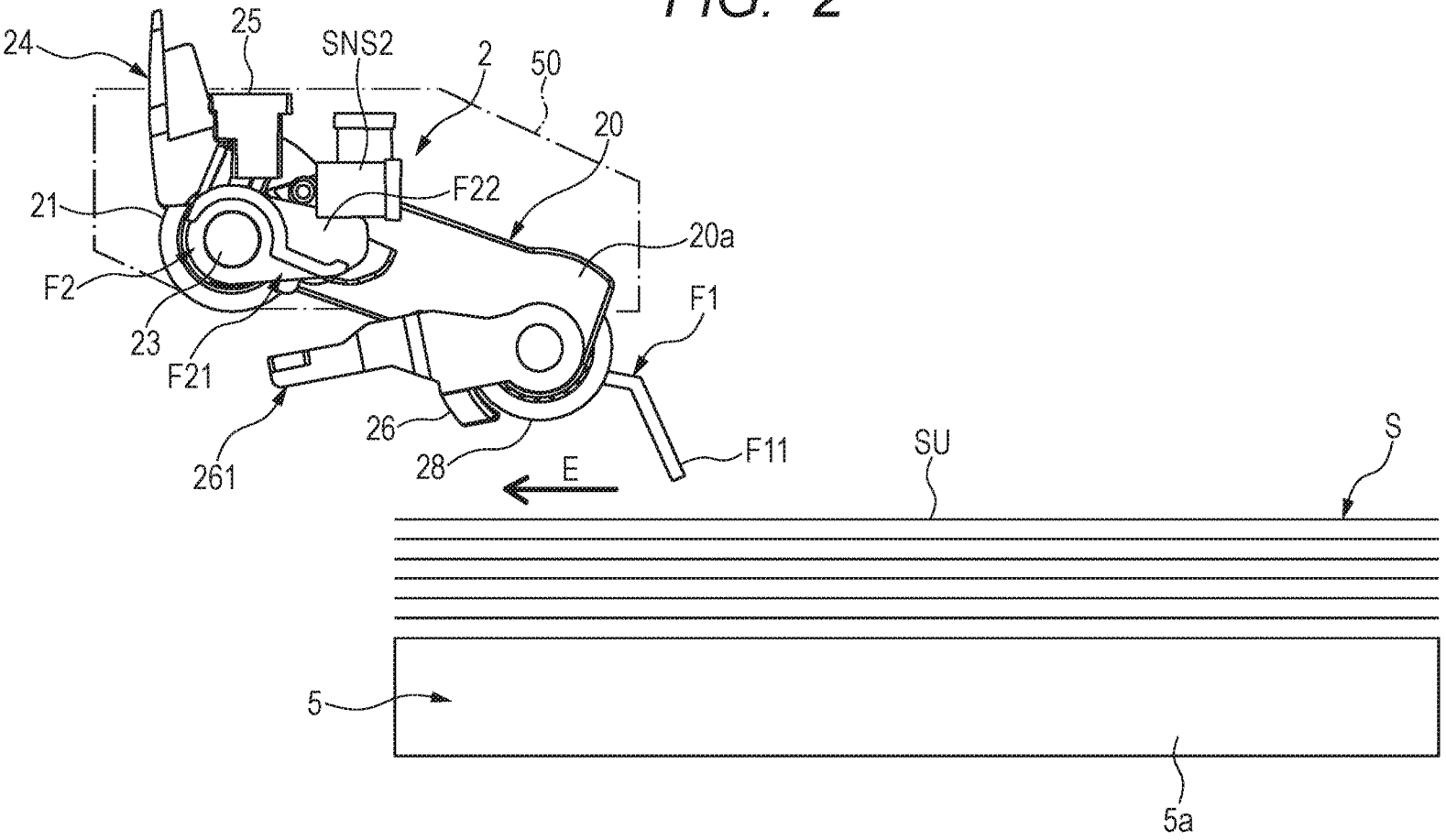
FIG. 2 is a view for schematically illustrating a sectional configuration of a sheet feeding unit and a stacking tray according to the first embodiment.

Next, the sheet raising and lowering unit 5 and the sheet feeding unit 2 according to this embodiment are described in detail with reference to FIG. 2 and FIG. 3. FIG. 2 is a view for schematically illustrating a sectional configuration of the sheet feeding unit and the stacking tray according to this embodiment, and FIG. 3 is a perspective view for schematically illustrating a configuration of the sheet feeding unit according to this embodiment.

Figure 3:
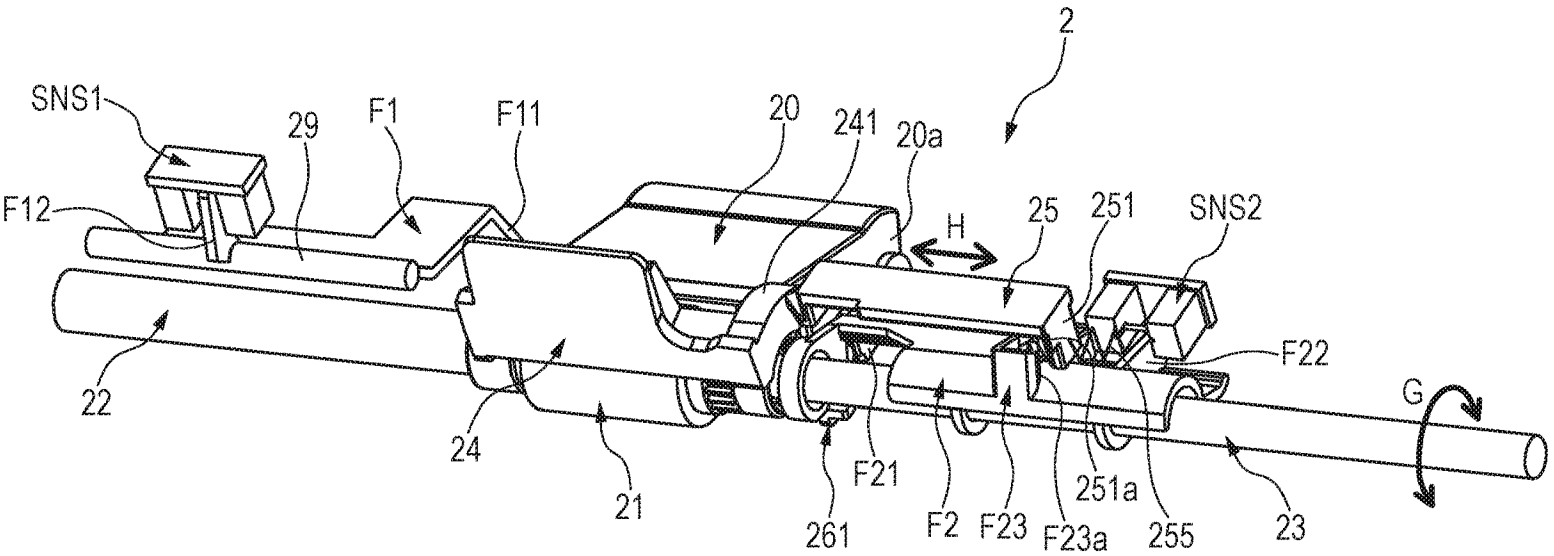
FIG. 3 is a perspective view for schematically illustrating a configuration of the sheet feeding unit according to the first embodiment.

As illustrated in FIG. 2 and FIG. 3, the sheet raising and lowering unit 5 includes the stacking tray 5*a* on which the sheets S are stacked, and the stacking tray 5*a* is raised and lowered with the driving source M1 (FIG. 6) controlled by the control unit 10 (FIG. 1 and FIG. 6). The control unit 10 is configured to control the driving source M1 based on each detection signal from the sheet presence/absence detection sensor SNS1 and the sheet surface detection sensor SNS2.

The sheet presence/absence detection sensor SNS1 and the sheet surface detection sensor SNS2 each have two statuses: "light transmitting state" and "light shielding state". The sheet presence/absence detection sensor SNS1 and the sheet surface detection sensor SNS2 are arranged so that a light emitting unit and a light receiving unit (hereinafter referred to as "detection unit") of each sensor are switched between the light transmitting state and the light shielding state by light shielding plates (light shielding members) F12 and F22 of corresponding flags. The sheet presence/absence detection sensor SNS1 is a light detection sensor configured to be switched between the light transmitting state and the light shielding state by movement (rotation) of the light shielding plate F12. The sheet surface detection sensor SNS2 is a light detection sensor configured to be switched between the light transmitting state and the light shielding state by movement (rotation) of the light shielding plate F22.

As illustrated in FIG. 2 and FIG. 3, in the sheet feeding unit 2, the pickup roller 28 serving as a feeding member is held by the feeding holder 20 serving as a feeding unit so as to be brought into abutment against the sheet S on the stacking tray 5*a* (stacking device) to feed the sheet S. The feeding holder 20 is configured to hold the feed roller (conveyance roller) 21 positioned on the downstream of the pickup roller 28 in a sheet feeding direction (direction of the arrow E) together with the pickup roller 28.

The sheet feeding unit 2 includes a holder support unit 50 serving as a support device that is arranged above the stacking tray 5*a* and configured to removably support the feeding holder 20. In the holder support unit 50, a slide shaft 22 and a drive shaft 23 are supported so as to be arranged in a straight line. The slide shaft 22 and the drive shaft 23 are configured to be fitted with a shaft portion of the feed roller 21 from both sides thereof, to thereby support the feeding holder 20 through intermediation of the feed roller 21. With this, the feeding holder 20 is held by the holder support unit 50 in a state of being supported by the slide shaft 22 and the drive shaft 23. The feeding holder 20 is supported so as to be rotatable about the slide shaft 22 and the drive shaft 23 being a rotation center urged toward a center portion of the feeding holder 20 with a spring (not shown).

The feeding holder 20 includes an open/close member 24 serving as a gripping portion which allows the user to grip when the feeding holder 20 is removed from between the slide shaft 22 and the drive shaft 23. The open/close member 24 is opened or closed with respect to a main body 20*a* of the feeding holder 20 when the feeding holder 20 is mounted to or removed from the holder support unit (support device) 50. The open/close member 24 is accommodated on the main body 20*a* side and closed in a normal state. When the user replaces the feeding holder 20, the open/close member 24 is used as the gripping portion in a state of being opened with respect to the main body 20*a*.

The sheet presence/absence detection sensor SNS1 and the sheet surface detection sensor SNS2 are fixed to the holder support unit 50 so as to be positioned as illustrated in FIG. 2 and FIG. 3. At a position of the holder support unit 50 opposed to the sheet presence/absence detection sensor SNS1, the light shielding plate F12 is supported by a support shaft 29, which is supported in parallel to the slide shaft 22, together with a sheet presence/absence detection unit F11 of a sheet presence/absence detection flag F1. The sheet presence/absence detection sensor SNS1 forms a first detection device capable of detecting presence or absence of a sheet on the stacking tray 5*a*, and the sheet surface detection sensor SNS2 forms a second detection device configured to detect that the stacking tray 5*a* is raised to enable a sheet to be fed.

Further, at a position of the holder support unit 50 opposed to the sheet surface detection sensor SNS2, a light shielding plate F22 is integrally formed on a sheet surface detection flag F2 that is supported in parallel to the drive shaft 23 and supported so as to be rotatable in the direction of the arrow G. Thus, the sheet surface detection flag F2 is arranged in the vicinity of the feeding holder 20 including the open/close member 24 with the drive shaft 23 being a rotation center. Further, a separation cam is supported in the vicinity of the sheet surface detection flag F2 of the holder support unit 50 so as to be slidable in the direction of the arrow H.

The separation cam 25 forms a switching device configured to switch the sheet surface detection sensor SNS2 to a state of detecting that the sheet can be fed when the mounting state of the feeding holder 20 to the holder support unit 50 is defective. The separation cam 25 is supported so as to be shiftable to a first state (see FIG. 4A) and a second state (see FIG. 4B). In the first state, the sheet surface detection sensor SNS2 is maintained in a state of being capable of performing normal detection when the mounting state of the feeding holder 20 is normal. In the second state, the sheet surface detection sensor SNS2 is switched to a state of being incapable of performing normal detection when the mounting state of the feeding holder 20 is defective. When the open/close member 24 is closed with respect to the main body 20*a*, the separation cam 25 shifts to the first state to enable the light shielding plate (light shielding member) F2 to move. When the open/close member 24 is opened with respect to the main body 20*a*, the separation cam 25 shifts to the second state to lock the light shielding plate 22 at a position of holding the sheet surface detection sensor SNS2 in the light shielding state. The separation cam 25 is constantly urged toward the feeding holder 20 side with a separation cam spring 255 that is arranged in a contracted state between a sheet surface flag abutment portion 251 and the holder support unit 50.

Further, when the feeding holder 20 is not mounted to the holder support unit 50, the separation cam 25 shifts to the second state to lock the light shielding plate F22 at a position of holding the sheet surface detection sensor SNS2 in the light shielding state.

The control unit 10 can make the following determination before sheet feeding processing by the pickup roller (feeding member) 28. That is, when the sheet surface detection sensor SNS2 having the state switched by the separation cam 25 detects that the sheet can be fed while the sheet presence/absence detection sensor SNS1 detects absence of a sheet, the control unit 10 determines that the mounting state of the feeding holder 20 to the holder support unit 50 is defective. When the control unit 10 determines that the mounting state of the feeding holder 20 is defective, the control unit 10 controls the notification unit 40 to issue a warning. With this, the user can immediately recognize the fact.

Here, the sheet presence/absence detection sensor SNS1 according to this embodiment has a status of the "light transmitting state" in the case of "absence of a sheet", and has a status of the "light shielding state" in the case of "presence of a sheet". Further, the sheet surface detection sensor SNS2 has a status of the "light transmitting state" in the case of "absence of a sheet surface", and has a status of the "light shielding state" in the case of "presence of a sheet surface". The sheet presence/absence detection sensor SNS1 may have a status of the "light shielding state" in the case of "absence of a sheet", and may have a status of the "light transmitting state" in the case of "presence of a sheet". Further, the sheet surface detection sensor SNS2 may have a status of the "light shielding state" in the case of "absence of a sheet surface", and may have a status of the "light transmitting state" in the case of "presence of a sheet surface". The relationship between the control of the raising and lowering operation and the status of the sensors is described later in detail.

In the feeding holder 20, a flag abutment portion 261 is supported so as to be coaxial with the pickup roller 28. A sheet surface detection unit 26 arranged in a central lower portion of the flag abutment portion 261 can detect an uppermost surface SU of a sheet bundle (S) raised or lowered by the sheet raising and lowering unit 5. When the sheet surface detection unit 26 detects the uppermost surface SU of the sheet bundle (S), the flag abutment portion 261 brings a tip end thereof into abutment against a sheet surface detection flag abutment portion F21 from below, to thereby change the phase of the sheet surface detection flag F2. With this, when the sheet surface detection flag F2 is rotated in the counterclockwise direction of FIG. 3 about the drive shaft 23, the light shielding plate F22 shields the detection unit of the sheet surface detection sensor SNS2 from light.

As illustrated in FIG. 3, the sheet presence/absence detection flag F1 is arranged in the vicinity of the slide shaft 22 so as to be rotatable and is configured to detect, with the sheet presence/absence detection unit F11, the uppermost surface SU of the sheet bundle (S) raised or lowered by the sheet raising and lowering unit 5 (see FIG. 2). When the sheet presence/absence detection unit F11 detects the uppermost surface SU of the sheet bundle (S), the sheet presence/absence detection flag F1 is rotated, and the light shielding plate F12 fixed to the support shaft 29 shields the detection unit of the sheet presence/absence detection sensor SNS1 from light.

The sheet presence/absence detection flag F1 and the sheet surface detection flag F2 are both configured to detect the uppermost surface SU of the sheet bundle (S), and the sheet presence/absence detection flag F1 includes the light shielding plate F12 having a larger width. The sheet presence/absence detection flag F1 is designed so as to detect the uppermost surface SU of the sheet bundle (S) at timing earlier than that of the light shielding plate F22 of the sheet surface detection flag F2 when the sheet S is raised.

Figure 4A:
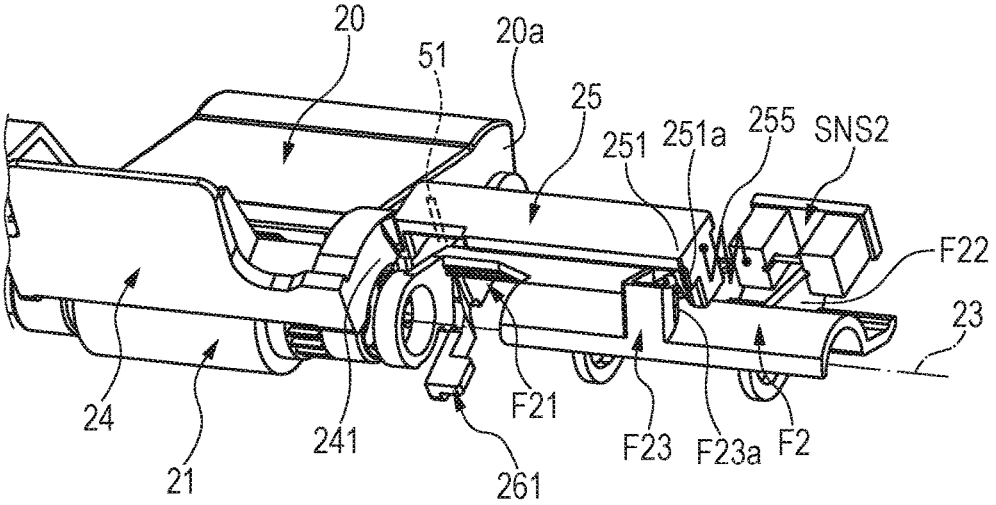
FIG. 4A is a perspective view for illustrating the configuration of the sheet feeding unit in a state before light shielding according to the first embodiment.
Figure 4B:
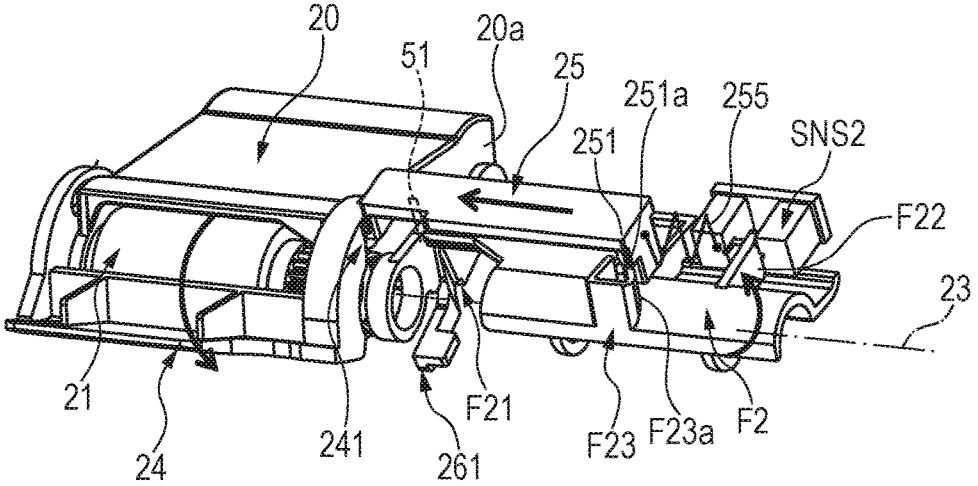
FIG. 4B is a perspective view for illustrating the configuration of the sheet feeding unit of FIG. 4A in a state after light shielding.

Next, the operations of the open/close member 24 and the separation cam 25 in the operation of removing the sheet feeding holder 20 is described with reference to FIG. 4A and FIG. 4B. FIG. 4A is an enlarged perspective view for schematically illustrating a configuration of the sheet feeding unit 2 according to this embodiment, and FIG. 4B is a perspective view for schematically illustrating an operation state of the sheet feeding unit 2 according to this embodiment.

As described above, in the feeding holder 20, the open/close member 24 to be operated by the user during replacement is arranged. The open/close member 24 is accommodated on the feeding holder 20 side in a normal state. When the user replaces the feeding holder 20, the open/close member 24 is used as the gripping portion.

When the open/close member 24 is in a closed state (FIG. 4A), a cam abutment portion 241 arranged on the open/close member 24 is held in abutment against the separation cam 25 to retain the separation cam 25 at a separation position. The separation cam 25 at the separation position is not brought into abutment against an inclined surface F23*a* formed so as to protrude from an upper surface of the cam abutment portion F23 in the sheet surface detection flag F2. Further, the cam abutment portion 241 has a shape that is gradually thinned along with the rotation of the open/close member 24 in the open direction. Therefore, when the open/close member 24 is in an opened state (FIG. 4B), the separation cam 25 urged toward the feeding holder 20 side with the separation cam spring 255 slides in accordance with an urging force toward the feeding holder 20 side along the cam abutment portion 241. The separation cam 25 in this case rotates the sheet surface detection flag F2 in the counterclockwise direction of FIG. 4B while causing a sliding contact portion 251*a* to slide in contact with the inclined surface F23*a* of the cam abutment portion F23.

That is, when the sliding contact portion 251*a* of the separation cam 25 is not brought into abutment against the inclined surface F23*a* of the cam abutment portion F23 as illustrated in FIG. 4A, the sheet surface detection flag F2 is rotated following the movement of the sheet surface detection unit 26. With this, the light shielding plate F22 is rotated to switch the sheet surface detection sensor SNS2 to the "light shielding state: presence of a sheet surface". Therefore, the sheet surface detection unit 26 can detect the uppermost surface SU of the sheet bundle (S).

When the open/close member 24 is in the opened state (FIG. 4B), the abutment of the cam abutment portion 241 against the separation cam 25 is cancelled due to the rotation of the cam abutment portion 241 toward the front side of FIG. 4B of the open/close member 24. The separation cam 25 released from the abutment against the cam abutment portion 241 of the open/close member 24 moves to an abutment position with respect to the inclined surface F23*a* of the cam abutment portion F23 in accordance with an urging force of the separation cam spring 255. When the separation cam 25 moves to the abutment position, the sheet surface flag abutment portion 251 of the separation cam 25 is brought into abutment against the cam abutment portion F23 of the sheet surface detection flag F2. When the separation cam 25 and the inclined surface F23*a* of the cam abutment portion F23 are brought into abutment against each other, the sheet surface detection flag F2 is pressed down to be rotated, and the light shielding plate F22 is locked in a state of shielding the detection unit of the sheet surface detection sensor SNS2 from light to constantly have a status of the "light shielding state: presence of a sheet surface".

Figure 5A:
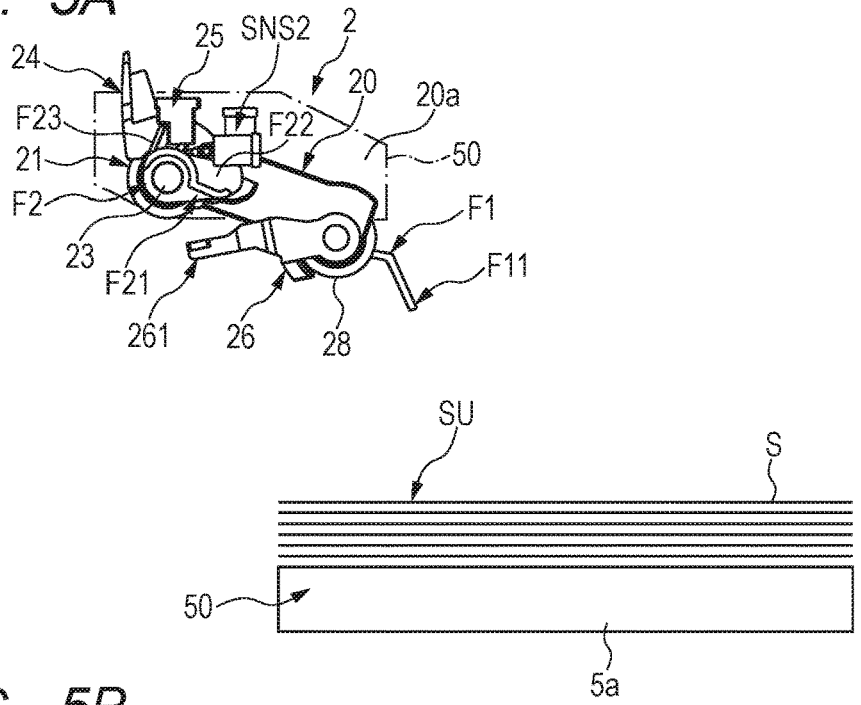
FIG. 5A is a view for schematically illustrating a state in which the stacking tray is positioned in a lowermost portion of the sheet feeding unit according to the first embodiment.
Figure 5B:
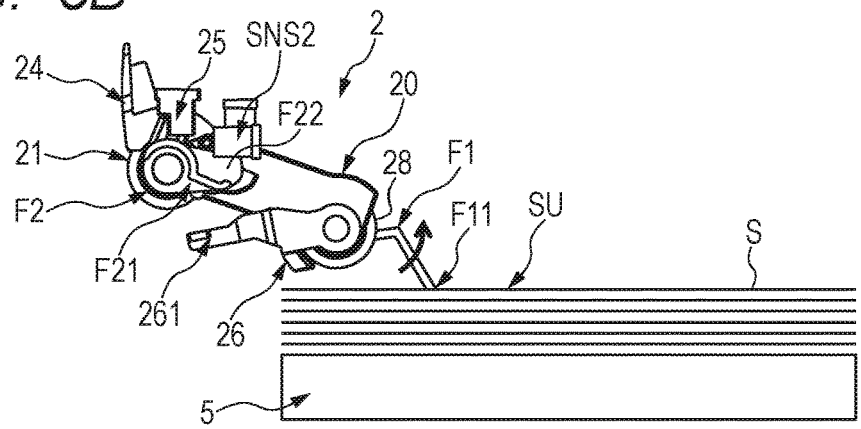
FIG. 5B is a view for schematically illustrating a state in which the stacking tray of FIG. 5A is raised to be brought into abutment against a sheet presence/absence detection flag.
Figure 5C:
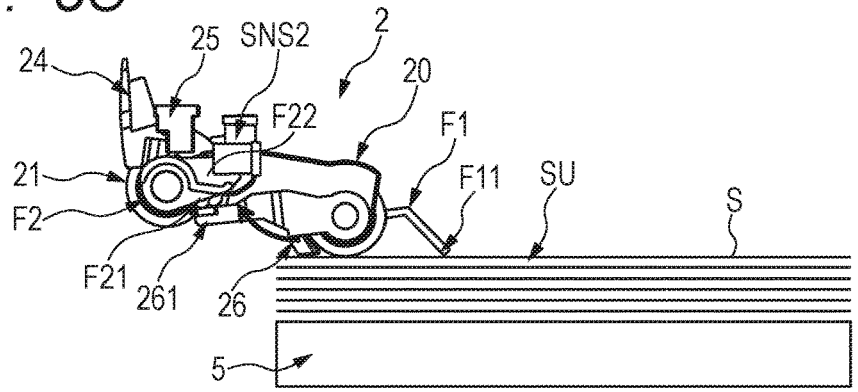
FIG. 5C is a view for schematically illustrating a state in which the stacking tray of FIG. 5B is further raised to be brought into abutment against a pickup roller.

Next, the status of each sensor and the raising and lowering operation are described with reference to FIG. 5A to FIG. 5C. FIG. 5A to FIG. 5C are views for schematically illustrating the transition during the raising and lowering of sheets according to this embodiment.

As described above, the raising and lowering operation is performed by the control unit 10 based on signals from the sheet presence/absence detection sensor SNS1 and the sheet surface detection sensor SNS2. In general, during an initial raising and lowering operation, the sheet raising and lowering unit 5 is raised or lowered to a predetermined position so as to feed the sheet S from the sheet bundle (S). The transition of each status in this case is as follows.

(1) At a time of the start of raising of the stacking tray 5*a* (at a time of the start of initial raising), the sheet presence/absence detection sensor SNS1 is set to the "light transmitting state: absence of a sheet", and the sheet surface detection sensor SNS2 is set to the "light transmitting state: absence of a sheet" (state of FIG. 5A).

(2) During the course of raising of the stacking tray 5*a* up to the position of the sheet presence/absence detection flag F1, the sheet presence/absence detection sensor SNS1 is set to the "light shielding state: presence of a sheet", and the sheet surface detection sensor SNS2 is set to the "light transmitting state: absence of a sheet surface" (state of FIG. 5B).

(3) When the uppermost surface SU of the sheet bundle (S) reaches a feeding position due to the raising of the stacking tray 5*a*, the sheet presence/absence detection sensor SNS1 is set to the "light shielding state: presence of a sheet", and the sheet surface detection sensor SNS2 is set to the "light shielding state: presence of a sheet surface" (state of FIG. 5C).

When the number of the sheets S on the stacking tray 5*a* is decreased successively along with the feeding operation due to the rotation drive of the pickup roller 28, the control unit 10 operates the driving source M1 to raise the stacking tray 5*a* by a certain amount in accordance with the decrease in number of the sheets S. Then, the raising operation is performed until the statuses of the sheet presence/absence detection sensor SNS1 and the sheet surface detection sensor SNS2 are changed, that is, until the sheet presence/absence detection sensor SNS1 is set to the "light shielding state: presence of a sheet" and the sheet surface detection sensor SNS2 is set to the "light shielding state: presence of a sheet surface".

Through the above-mentioned control, the sheet S is fed through the rotation of the pickup roller 28 and the feed roller 21 while the uppermost surface SU of the sheet bundle (S) stacked on the stacking tray 5*a* is raised to an appropriate position. When the sheet S is fed to lower the uppermost surface SU of the sheet bundle (S), and the sheet surface detection sensor SNS2 has a status of the "light transmitting state: absence of a sheet surface", the raising operation is performed again to set the uppermost surface SU to an appropriate position. In this case, the sheet presence/absence detection sensor SNS1 constantly has a status of the "light shielding state: presence of a sheet". This control is repeated to feed the sheets until the stacking tray 5*a* becomes out of the sheet S. When the stacking tray 5*a* becomes out of the sheet S, the sheet presence/absence detection unit F11 sinks into an opening portion (not shown) formed in the stacking tray 5*a*, with the result that the sheet presence/absence detection sensor SNS1 is set to the "light transmitting state: absence of a sheet". Based on this, the control unit 10 stops the feeding operation and causes the notification unit 40 to issue a warning to notify the user of the "absence of a sheet".

Meanwhile, when proper setting is not performed, for example, the sheet feeding holder 20 is not mounted or the open/close member 24 remains opened, that is, when the sheet surface detection sensor SNS2 constantly has a status of the "light shielding state: presence of a sheet surface" due to the movement of the separation cam 25, the following is performed. In this case, at a time of the start of initial raising, the sheet presence/absence detection sensor SNS1 has a status of the "light transmitting state: absence of a sheet", and the sheet surface detection sensor SNS2 has a status of the "light shielding state: presence of a sheet surface". Thus, there is given a combination of statuses that may not be obtained at a time of the initial raising and lowering operation before the sheet feeding operation (before the sheet feeding processing by the pickup roller 28).

Therefore, the "absence of a roller", that is, the fact that the feeding holder 20 is not mounted can be detected before the sheet raising and lowering unit 5 performs the raising and lowering operation, and hence damages to the device and the like caused by the raising and lowering operation when the feeding holder 20 is not mounted can be prevented. That is, when initial sheet surface detection is performed while the feeding holder 20 is not mounted, the stacking tray 5*a* is not raised, and it can be detected that the feeding holder 20 is not mounted properly. When the initial detection of a sheet surface is performed while the feeding holder 20 is not mounted, the stacking tray 5*a* is not raised, and it can be detected that the feeding holder 20 is not mounted.

In this embodiment, it can be determined that the feeding holder 20 is not mounted properly before the sheet feeding processing by the pickup roller 28. Thus, the damages to the surrounding constituent portions and the occurrence of trouble such as jam can be avoided.

Second Embodiment

Figure 7A:
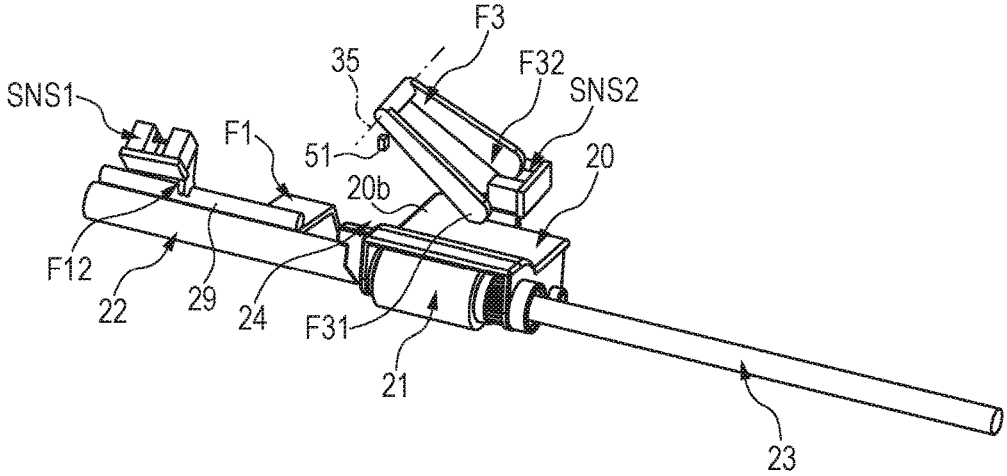
FIG. 7A is a perspective view for schematically illustrating a configuration of a sheet feeding unit according to a second embodiment of the present invention.

Next, a second embodiment of the present invention is described with reference to FIG. 7A, FIG. 7B, and FIG. 8. FIG. 7A is a perspective view for schematically illustrating a configuration of a sheet feeding unit according to the second embodiment, and FIG. 7B is a sectional view for schematically illustrating a sectional configuration of the sheet feeding unit and a stacking tray according to this embodiment.

The second embodiment is different from the first embodiment in that the setting position of the sheet surface detection sensor SNS2 is changed, and that a holder detection flag F3 is arranged instead of the sheet surface detection flag F2 and the separation cam 25. In this embodiment, the same components as those of the first embodiment are denoted by the same reference symbols, and description of the components having the same configurations and functions are omitted.

Figure 7B:
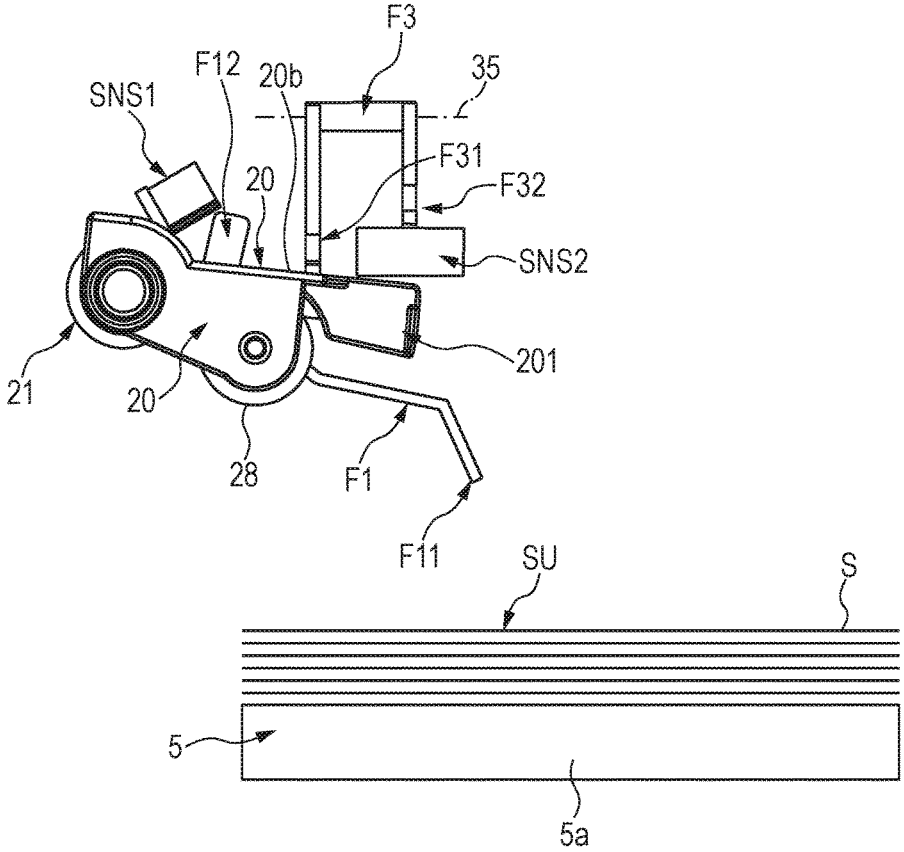
FIG. 7B is a view for schematically illustrating a sectional configuration of the sheet feeding unit and a stacking tray according to the second embodiment.

As illustrated in FIG. 7A and FIG. 7B, in the same manner as in the first embodiment, the pickup roller 28 and the feed roller 21, which is configured to feed the sheet S sent out by the pickup roller 28 to the downstream in the sheet feeding direction, are held in the feeding holder 20. The feeding holder 20 is arranged so as to be rotatable about the slide shaft 22 and the drive shaft 23 being the rotation center urged with a spring (not shown).

In an upper portion of the feeding holder 20, a rotation base of the holder detection flag F3 is supported by the holder support unit 50 (see FIG. 2) through intermediation of a shaft 35 so as to be rotatable. The shaft 35 is supported by the holder support unit 50 in a state of facing the direction orthogonal to the axial direction of the slide shaft 22 and the drive shaft 23. The holder detection flag F3 forms a switching device configured to switch the sheet surface detection sensor SNS2 to a state of detecting that the sheet S can be fed when the mounting state of the feeding holder 20 to the holder support unit 50 is defective.

Figure 8:
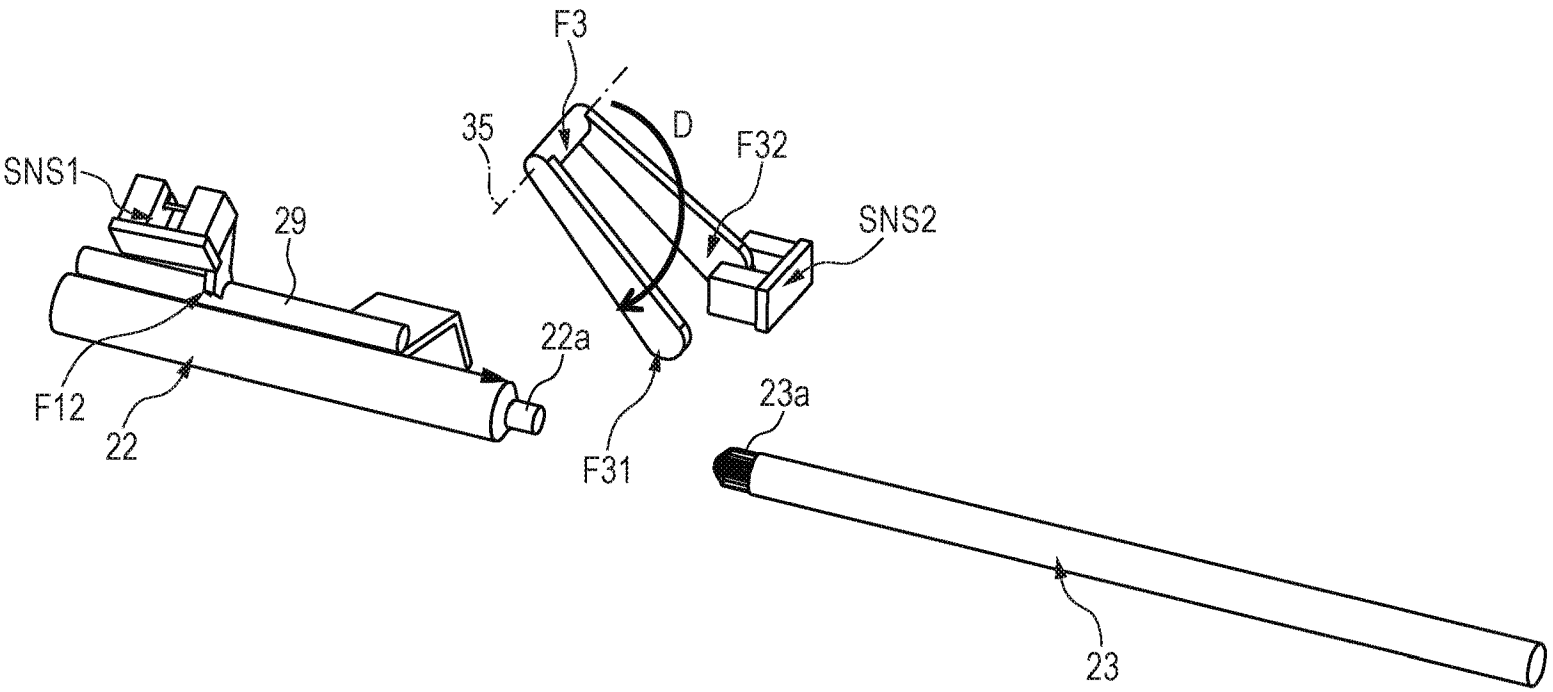
FIG. 8 is a perspective view for illustrating a state in which a feeding holder is removed from the sheet feeding unit according to the second embodiment.

Next, with reference to FIG. 8, description is made of an operation in the case where the feeding holder 20 is not mounted. FIG. 8 is a perspective view for illustrating a state in which the feeding holder 20 is removed from the sheet feeding unit 2 according to this embodiment.

When the feeding holder 20 is not mounted between the slide shaft 22 and the drive shaft 23 as illustrated in FIG. 8, the holder detection flag F3 is rotated by its own weight in the direction of the arrow D about the shaft 35. With this, the light shielding plate F32 is set to stand by under the regulation of a regulation unit 51 (FIG. 7A) at a position of shielding the detection unit of the sheet surface detection sensor SNS2 from light. A support protrusion 22*a* with respect to the feed roller 21 is formed at an end of the slide shaft 22, and a spline portion 23*a* that can be fitted to couple with a spline hole (not shown) of the feed roller 21 is formed at an end of the drive shaft 23.

The sheet surface detection sensor (second detection device) SNS2 according to this embodiment is a light detection sensor configured to be switched between the light transmitting state and the light shielding state by movement of the light shielding plate (light shielding member) F32. When the feeding holder 20 (see FIGS. 7A and 7B) is mounted to the holder support unit 50 (see FIG. 2), the holder detection flag (switching member) F3 shifts to the above-mentioned first state under the condition that a holder detection flag abutment portion F31 is brought into abutment against an upper surface 20*b* of the holder support unit 50. With this, the light shielding plate (light shielding member) F32 is movable along with the operation of the feeding holder 20. Further, when the feeding holder 20 is not mounted to the holder support unit 50, the holder detection flag (switching member) F3 shifts to the above-mentioned second state without being brought into abutment against the feeding holder 20, to thereby hold the light shielding plate F32 at a position of setting the sheet surface detection sensor SNS2 in the light shielding state.

When the feeding holder 20 is mounted between the slide shaft 22 and the drive shaft 23, the holder detection flag abutment portion F31 of the holder detection flag F3 is brought into abutment against the upper surface 20*b* of the feeding holder 20. With this, the detection unit of the sheet surface detection sensor SNS2 is prevented from being shielded from light irrespective of the rotation position of the feeding holder 20.

Accordingly, when the feeding holder 20 is mounted, the holder detection flag F3 does not influence the raising and lowering operation of the sheet raising and lowering unit 5 and the sheet feeding operation. Meanwhile, when the feeding holder 20 is not mounted, the status of the sheet surface detection sensor SNS2 can be constantly set to the "light shielding state: presence of a sheet surface".

The status of each sensor and the raising and lowering operation are the same as those of the first embodiment, and hence description thereof is omitted. In this embodiment, the same effects as those of the first embodiment can be obtained, and the number of components can be reduced as compared to that of the first embodiment through use of the holder detection flag F3, with the result that the configuration which is reduced in cost can be achieved.

The first and second embodiments are described above, but the present invention is not limited to the above-mentioned embodiments. Further, the effects described in the embodiments of the present invention are the most preferred effects obtained from the present invention, and the effects of the present invention are not limited to those described in the embodiments of the present invention. The first and second embodiments may also be appropriately combined.

The first and second embodiments are described through illustration of a printer including an image forming unit configured to perform an electrophotographic image forming process as an example, but the present invention is not limited thereto. The present invention is also applicable to, for example, a printer including an image forming unit configured to perform an inkjet image forming process for forming an image on a sheet by ejecting an ink liquid through a nozzle.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A sheet feeding apparatus for feeding a sheet, comprising:

a stacking device onto which a sheet is stacked and which is movable between an upper side and a lower side;

a feeding unit comprising a feeding member configured to contact the sheet on the stacking device to feed the sheet, the feeding unit being configured to hold the feeding member;

a support device arranged on the upper side of the stacking device and configured to removably support the feeding unit;

a detection device configured to be switched between a light transmitting state and a light shielding state;

an abutment member configured to move by contacting a sheet on the stacking device;

a light shielding member configured to switch the state of the detection device to the light shielding state by movement of the abutment member; and a switching device configured to switch between a first state in which the state of the detection device is maintained in the light transmitting state in a case in which the feeding unit is mounted to the support device and a second state in which the state of the detection device is switched to the light shielding state in a case in which the feeding unit is not mounted to the support device.

2. The sheet feeding apparatus according to claim 1, wherein the switching device is movable in a direction of a rotation axis of the feeding member.

3. The sheet feeding apparatus according to claim 1, wherein the detection device comprises a light detection sensor.

4. An image forming apparatus comprising:

a stacking device onto which a sheet is stacked and which is movable between an upper side and a lower side;

a feeding unit comprising a feeding member configured to contact the sheet on the stacking device to feed the sheet, the feeding unit being configured to hold the feeding member;

an image forming unit configured to form an image on a sheet fed by the feeding unit;

a support device arranged on the upper side of the stacking device and configured to removably support the feeding unit;

a detection device configured to be switched between a light transmitting state and a light shielding state;

an abutment member configured to move by contacting a sheet on the stacking device;

a light shielding member configured to switch the state of the detection device to the light shielding state by movement of the abutment member; and a switching device configured to switch between a first state in which the state of the detection device is maintained in the light transmitting state in a case in which the feeding unit is mounted on the support device and a second state in which the state of the detection device is switched to the light shielding state in a case in which the feeding unit is not mounted to the support device.

5. The image forming apparatus according to claim 4, wherein the switching device is movable in a direction of a rotation axis of the feeding member.

6. The image forming apparatus according to claim 4, wherein the detection device comprises a light detection sensor.

* * * * *